US005291850A

United States Patent [19]

Gries et al.

[11] Patent Number: 5,291,850

[45] Date of Patent: Mar. 8, 1994

[54] GOLFER STROKE-HOLE INDICATING DEVICES

[76] Inventors: LeRoy W. Gries, P.O. Box 2333, Florence, Oreg. 97439; Van M. Lund, 2294 Elm Ridge Dr., Northbrook, Ill. 60062

[21] Appl. No.: 992,718

[22] Filed: Dec. 18, 1992

[51] Int. Cl.[5] ..... A63F 1/18; G09F 11/04; G09F 11/20

[52] U.S. Cl. ..... 116/222; 116/223; 116/225; 116/309; 116/323; 273/DIG. 26

[58] Field of Search ..... 40/491, 492; 116/222, 116/223, 224, 225, 309, 321, 323; 273/32 H, DIG. 26

[56] References Cited

U.S. PATENT DOCUMENTS

| | | | |
|---|---|---|---|
| 2,012,023 | 8/1935 | Richardson | 116/224 |
| 3,431,885 | 3/1969 | Miklas | 40/491 X |
| 3,995,379 | 12/1976 | Werber | 40/491 X |
| 4,212,261 | 7/1980 | Gaetano | 116/224 |
| 4,233,768 | 11/1980 | Bromberg | 40/489 |
| 4,322,610 | 3/1982 | Randolph | 235/114 |
| 4,456,821 | 6/1984 | Harter | 235/78 R |
| 4,745,875 | 5/1988 | Timleck | 116/222 |
| 4,960,029 | 10/1990 | Nelson | 84/473 |
| 5,013,069 | 5/1991 | Hardin | 283/48.1 |
| 5,094,451 | 3/1992 | Glamack | 273/32 H |
| 5,136,965 | 8/1992 | Tamburro, Jr. | 116/321 |

*Primary Examiner*—William A. Cuchlinski, Jr.
*Assistant Examiner*—W. Morris Worth
*Attorney, Agent, or Firm*—Van Metre Lund

[57] ABSTRACT

In indicating devices of the invention, a slide member is disposed between two registering rectangular sheets forming a holding member and is guided for relative rectilinear movement in certain embodiments and for relative rotational movement in other embodiments, the position of the slide member relative to the holding member being adjustable according to differences in handicap and to indicate stroke holes on which strokes are to be given by one golfer to another golfer in a accordance with a particular order of handicap order numbers of a golf course. Certain embodiments are designed for use separately from a golf course score card while others include indicia to be usable as golf course score card and to more directly indicate stroke holes.

15 Claims, 13 Drawing Sheets

FIG. 1

10

11

| | | | | | | | | | | | |
|---|---|---|---|---|---|---|---|---|---|---|---|
| MEN | BLUE TEES | 397 | 370 | 397 | 197 | 341 | 498 | 153 | 535 | 401 | 3269 |
| | WHITE TEES | 389 | 370 | 390 | 185 | 328 | 498 | 141 | 535 | 393 | 3229 |
| | PAR | 4 | 4 | 4 | 3 | 4 | 5 | 3 | 5 | 4 | 36 |
| | | | | | | | | | | | |
| | | | | | | | | | | | |
| MENS HANDICAP | | 9 | 15 | 7 | 11 | 13 | 3 | 17 | 1 | 5 | |
| | WE | | | | | | | | | | |
| HOLE NUMBER | | 1 | 2 | 3 | 4 | 5 | 6 | 7 | 8 | 9 | OUT |
| | THEY | | | | | | | | | | |
| LADIES HANDICAP | | 7 | 11 | 1 | 17 | 3 | 13 | 15 | 5 | 9 | |
| | | | | | | | | | | | |
| | | | | | | | | | | | |
| LADIES | PAR | 4 | 4 | 4 | 3 | 4 | 5 | 3 | 5 | 4 | 36 |
| | RED TEES | 373 | 382 | 376 | 125 | 319 | 429 | 128 | 475 | 311 | 2896 |

14 15 13 12

FIG. 2

10

11 12

| | | | | | | | | | | | | | | |
|---|---|---|---|---|---|---|---|---|---|---|---|---|---|---|
| MEN | BLUE TEES | 430 | 479 | 393 | 162 | 510 | 204 | 319 | 365 | 414 | 3276 | 6545 | | |
| | WHITE TEES | 422 | 479 | 393 | 153 | 510 | 195 | 308 | 354 | 414 | 3228 | 6457 | | |
| | PAR | 4 | 5 | 4 | 3 | 5 | 3 | 4 | 4 | 4 | 36 | 72 | | |
| | | | | | | | | | | | | | | |
| | | | | | | | | | | | | | | |
| MENS HANDICAP | | 6 | 4 | 10 | 18 | 2 | 14 | 16 | 12 | 8 | | | | |
| | WE | | | | | | | | | | | | | |
| HOLE NUMBER | | 10 | 11 | 12 | 13 | 14 | 15 | 16 | 17 | 18 | IN | TOT | HDP | NET |
| | THEY | | | | | | | | | | | | | |
| LADIES HANDICAP | | 4 | 2 | 14 | 16 | 12 | 6 | 10 | 18 | 8 | | | | |
| | | | | | | | | | | | | | | |
| | | | | | | | | | | | | | | |
| LADIES | PAR | 5 | 5 | 4 | 3 | 5 | 3 | 4 | 4 | 5 | 38 | 74 | | |
| | RED TEES | 320 | 400 | 323 | 138 | 415 | 171 | 292 | 336 | 337 | 2733 | 5629 | | |

14 16

| | | | | | | | | | | | |
|---|---|---|---|---|---|---|---|---|---|---|---|
| MEN | BLUE TEES | 397 | 370 | 397 | 197 | 341 | 498 | 153 | 535 | 401 | 3269 |
| | WHITE TEES | 389 | 370 | 390 | 185 | 328 | 498 | 141 | 535 | 393 | 3229 |
| | PAR | 4 | 4 | 4 | 3 | 4 | 5 | 3 | 5 | 4 | 36 |
| | | | | | | | | | | | |
| | | | | | | | | | | | |
| MENS HANDICAP | | 9 | 15 | 7 | 11 | 13 | 3 | 17 | 1 | 5 | |
| WE | | | | | | | | | | | |
| HOLE NUMBER | | 1 | 2 | 3 | 4 | 5 | 6 | 7 | 8 | 9 | OUT |
| THEY | | | | | | | | | | | |
| LADIES HANDICAP | | 7 | 11 | 1 | 17 | 3 | 13 | 15 | 5 | 9 | |
| | | | | | | | | | | | |
| | | | | | | | | | | | |
| LADIES | PAR | 4 | 4 | 4 | 3 | 4 | 5 | 3 | 5 | 4 | 36 |
| | RED TEES | 373 | 362 | 376 | 125 | 319 | 429 | 126 | 475 | 311 | 2896 |

| | | | | | | | | | | | |
|---|---|---|---|---|---|---|---|---|---|---|---|
| MEN | BLUE TEES | 397 | 370 | 397 | 197 | 341 | 498 | 153 | 535 | 401 | 3269 |
| | WHITE TEES | 389 | 370 | 390 | 185 | 328 | 498 | 141 | 535 | 393 | 3229 |
| | PAR | 4 | 4 | 4 | 3 | 4 | 5 | 3 | 5 | 4 | 36 |
| | | | | | | | | | | | |
| | | | | | | | | | | | |
| MENS HANDICAP | | 9 | 15 | 7 | 11 | 13 | 3 | 17 | 1 | 5 | |
| WE | | | | | | | | | | | |

151
152
153
154
155
156
157
158
159
149
147
171
175
150
160
161
162
163
164
165
166
167
168
146
148
172
176
PULL
PULL
18 17 16 15 14 13 12 11 10 9 8 7 6 5 4 3 2 1

FIG. 21

181 180

| | | | | | | | | | | | |
|---|---|---|---|---|---|---|---|---|---|---|---|
| MEN | BLUE TEES | 397 | 370 | 397 | 197 | 341 | 498 | 153 | 535 | 401 | 3289 |
| | WHITE TEES | 389 | 370 | 390 | 185 | 328 | 498 | 141 | 535 | 393 | 3229 |
| | PAR | 4 | 4 | 4 | 3 | 4 | 5 | 3 | 5 | 4 | 36 |
| | HANDICAP | 9 | 15 | 7 | 11 | 13 | 3 | 17 | 1 | 5 | |
| | STROKE HOLE INDICATORS | 211 | 212 | 213 | 214 | 215 | 216 | 217 | 218 | 219 | |
| HANDICAP DIFFERENCE → 1 199 | | | | | | | | | | | |
| | | | | | | | | | | | |
| | | | | | | | | | | | |
| | WE | | | | | | | | | | |
| | HOLE NUMBER | 1 | 2 | 3 | 4 | 5 | 6 | 7 | 8 | 9 | OUT |
| | THEY | | | | | | | | | | |
| | | | | | | | | | | | |
| | | | | | | | | | | | |
| HANDICAP DIFFERENCE → 1 200 | | | | | | | | | | | |
| LADIES | STROKE HOLE INDICATORS | 231 | 232 | 233 | 234 | 235 | 236 | 237 | 238 | 239 | |
| | HANDICAP | 7 | 11 | 1 | 17 | 3 | 13 | 15 | 5 | 9 | |
| | PAR | 4 | 4 | 4 | 3 | 4 | 5 | 3 | 5 | 4 | 36 |
| | RED TEES | 373 | 362 | 376 | 125 | 319 | 429 | 126 | 475 | 311 | |

188 186 181 182 183

FIG. 22

181 182 180 184

| | | | | | | | | | | | | | | |
|---|---|---|---|---|---|---|---|---|---|---|---|---|---|---|
| MEN | BLUE TEES | 430 | 479 | 393 | 162 | 510 | 204 | 319 | 365 | 414 | 3276 | 6545 | | |
| | WHITE TEES | 422 | 479 | 393 | 153 | 510 | 195 | 308 | 354 | 414 | 3228 | 6457 | | |
| | PAR | 4 | 5 | 4 | 3 | 5 | 3 | 4 | 4 | 4 | 36 | 72 | | |
| | HANDICAP | 6 | 4 | 10 | 18 | 2 | 14 | 16 | 12 | 8 | | | | |
| | STROKE HOLE INDICATORS | 241 | 242 | 243 | 244 | 245 | 246 | 247 | 248 | 249 | | | | |
| HANDICAP DIFFERENCE → 10 261 | | | | | | | | | | | | | | |
| | | | | | | | | | | | | | | |
| | | | | | | | | | | | | | | |
| | WE | | | | | | | | | | | | | |
| | HOLE NUMBER | 10 | 11 | 12 | 13 | 14 | 15 | 16 | 17 | 18 | IN | TOT. | HDP. | NET |
| | THEY | | | | | | | | | | | | | |
| | | | | | | | | | | | | | | |
| | | | | | | | | | | | | | | |
| HANDICAP DIFFERENCE → 10 262 | | | | | | | | | | | | | | |
| LADIES | STROKE HOLE INDICATORS | 251 | 252 | 253 | 254 | 255 | 256 | 257 | 258 | 259 | | | | |
| | HANDICAP | 4 | 2 | 14 | 18 | 12 | 6 | 10 | 16 | 8 | | | | |
| | PAR | 5 | 5 | 4 | 3 | 5 | 3 | 4 | 4 | 5 | 38 | 74 | | |
| | RED TEES | 320 | 400 | 323 | 138 | 415 | 171 | 292 | 336 | 337 | 2733 | 5629 | | |

189 186 190 181

GOLFER STROKE-HOLE INDICATING DEVICES

BACKGROUND OF THE INVENTION

1. Field of the Invention

This invention relates to golfer stroke-hole indicating devices and more particularly to devices which are usable easily and conveniently to provide accurate indications of holes of a golf course on which strokes may be given by one golfer to another. The devices of the invention are highly reliable and are readily and economically manufacturable.

2. Background of the Prior Art

A golf handicap system has been in use for many years which allows golfers to adjust for differences in abilities and equalize the chances of winning a match. This handicap system is an excellent system which has been developed to a highly sophisticated degree in the United States under the auspices of the United States Golf Association, and under regional and local associations, golf clubs and golf course managements. In the operation of the system, each golfer reports his scores to a handicap-determining body and is assigned a handicap based upon his prior performances in relation to the "par" score that an expert golfer would be expected to make on an 18 hole course in errorless play without flukes under ordinary weather conditions, allowing two strokes on each putting green. With the system, a golfer having an established handicap may compete on a fair basis with any other such golfer in the United States or for that matter, in many foreign countries in which the system has also been established.

In the operation of the system, two golfers having a handicaps of 10 and 15, for example, may be expected have a scores of 10 and 15 greater than par when both play to substantially the best of their respective abilities. Using the handicap system, competitions between the two golfers may be arranged on a medal play basis, based upon the total scores without regard to scores on particular holes. However, friendly competitions between two golfers are almost always arranged on a match play basis in which holes are played one-by-one, each being won, lost or halved. A golfer becomes the winner when he or she wins a number of holes which is in excess of those that he or she has lost and which is in excess of any remaining holes.

To equalize match play competitions, a system has been established to indicate the order of holes at which handicap strokes are to be given or received, the order being based upon the estimated relative difficulty of play of the holes. The most difficult hole of any particular course is No. 1 in the handicap order, the next most difficult hole is No. 2, and so on, the least difficult being the No. 18 handicap hole. Such handicap order numbers are different for different courses and are generally different for men and ladies. In a particular course, for example, the hole which is No. 1 in the handicap order for men may be No. 7 in the order of play, while the hole which is No. 1 in the handicap order for ladies may be No. 3 in the order of play.

In a match between a 10 handicap golfer and a 15 handicap golfer, the 10 handicap golfer is expected to give one stroke on each of the five holes having handicap order numbers of 1, 2, 3, 4 and 5. If the No. 1 handicap hole is the No. 7 hole in the playing order, the 15 handicap golfer wins that hole if both have the same score thereon, the golfers halve the hole if the score of the 15 handicap golfer is one greater than that of the 10 handicap golfer and the 15 handicap golfer loses the hole only if his or her score is 2 strokes or more greater than that of the 10 handicap golfer.

The handicap order numbers are established by the management of each golf course and are typically printed on the score card of each course. In scoring a match between two golfers, a scorer is required to carefully study the score card to determine those holes having a handicap order number equal to or less than the number of strokes to be given by one golfer to another. Usually, the scorer circles the hole numbers of the stroke holes, or otherwise marks such holes. Then he or she may mark each hole on behalf of one golfer with a +, − or 0, according to whether that golfer wins, loses or halves the hole, after taking into account whether a stroke is given or received by that golfer on that hole.

SUMMARY OF THE INVENTION

This invention is based upon a recognition and discovery of problems with the prior art and was evolved with the general object of solving such problems and otherwise improving upon and facilitating use of the existing system.

A more specific object of the invention is to provide devices which simplify and facilitate the rapid and accurate determination of stroke holes and which are readily and economically manufacturable.

The invention recognizes that the problems with the existing handicap system are not with the way in which handicaps are established or with the way in which the handicap orders for holes of particular golf courses are determined. It is recognized that the handicap system itself is excellent and the problems are rather with the way the handicap system is presented for use by ordinary golfers.

The aforementioned mode of use of the handicap system, once understood, may seem to be relatively simple and readily applied. However, it has been found that even very skilled and experienced scorers can make many mistakes. It has also been observed that many golfers are confused about the operation and application of the handicap system, increasing their frustrations about what for most participants can be, at times, a very highly frustrating sport.

It has been further observed and discovered that a source of the confusion is that there are typically two rows of handicap order numbers on a score card, one for men and the other for ladies, among a total of eight or more rows of numbers on the card. These handicap order numbers are usually in smaller font size, are different for different courses and are in most cases different for men and women, the result being that even very experienced golfers can become confused. Another serious source of difficulty arises when, as is very frequently the case, one golfer of a threesome or foursome is delegated with the chore of being the scorer and attempts to use a single score card to score more than one match between two individual golfers or pairs of golfers and when the strokes given in each match differs from those given in other matches. The problem is even further compounded when, as is sometimes the case, there is one match between two husband and wife couples making up a foursome, another between the two husbands and a third between the two wives.

The invention recognizes the need for a means for directly indicating, from a selection of a difference in handicaps, the stroke holes on which strokes are to be given. In accordance with the invention, a device is provided which is for use on a golf course having holes to which handicap order numbers have been assigned in a particular order. Each device may comprise indicia of a series of consecutive numbers, for example, for forming a plurality of first indicating means for indicating differences in handicaps, and may further comprise indicia groups of one or more numbers, for example, for forming a plurality of corresponding second indicating means for providing indications of stroke holes, in accordance with the particular order of handicap order numbers of the golf course on which the device is to be used. Through selection of one of the first indicating means in accordance with a difference in handicaps between one golfer and another, a corresponding one of the second indicating means is selected to directly provide an indication by the corresponding one of said second indicating means of holes of golf course on which strokes are to be given by the one golfer to another golfer in accordance with the particular order of handicap order numbers which applies to a particular golf course.

The device can be relatively simple in construction and is easy to use. Through the direct indication of stroke holes, the device facilitates a quick and ready scoring of a single match between two golfers or two pairs of golfers, and it can also be readily used for accurate scoring of multiple matches recorded on a single score card, avoiding the confusions encountered in the prior art.

Preferably, and in accordance with a specific feature of the invention, the device carries indicia including indicia to explain the operation and facilitate use of the excellent handicap system which has been developed under the auspices of the United States Golf Association, and under regional and local associations, golf clubs and golf course managements. The indicia may also include explanations of important rules of golf and golf courtesy, the layout of holes of the golf course for which is designed, local rules and other important information, as well as advertising materials.

Further features of the invention relate to the provision of first and second members which are preferably of sheet material and are associated for relative movement, the members being guided for relative rectilinear movement in certain embodiments and for relative pivotal movement in other embodiments. Selection means are movable through relative movement of such members to a position in registering relation to one of a plurality of handicap difference indicia means, while selection means movable through relative movement of such members to a position in registering relation to one of a plurality of hole-identifying indicia means which corresponds to a handicap difference number selected through the first indicating means.

In accordance with further features of the invention, devices are provided of a type which is independent of score cards but which a scorer may use to quickly and accurately determine stroke holes when using score cards for conventional scoring purposes. Devices of this type are usable over and over again and are preferably of a durable construction. Devices are also provided of a type which serve as score cards and which more directly indicate stroke holes to facilitate scoring. Important features of the invention relate to constructions of both types of devices which are such as to minimize costs of manufacture while the devices are easy to use and highly reliable.

This invention contemplates other objects, features and advantages which will become more fully apparent from the following detailed description taken in conjunction wire the accompanying drawings.

BRIEF DESCRIPTION OF THE DRAWINGS

FIGS. 1 and 2 are provided for explanatory purposes, illustrating front nine and back nine portions of a score card of a typical golf course for which illustrated devices of the invention are designed;

FIG. 21 illustrates another form of device of the invention, operative as a score card and otherwise similar to the devices of FIGS. 12–20 but in which a slide member is held between two sheet portions of a holding member for relative pivotal movement;

FIG. 22 is a view similar to FIG. 20, but shows an opposite side of the device and back nine indicia thereon, and also shows the condition of the device in which the slide member has been rotated through a certain angle to a different indicating position.

DESCRIPTION OF PREFERRED EMBODIMENTS

Figure 3:
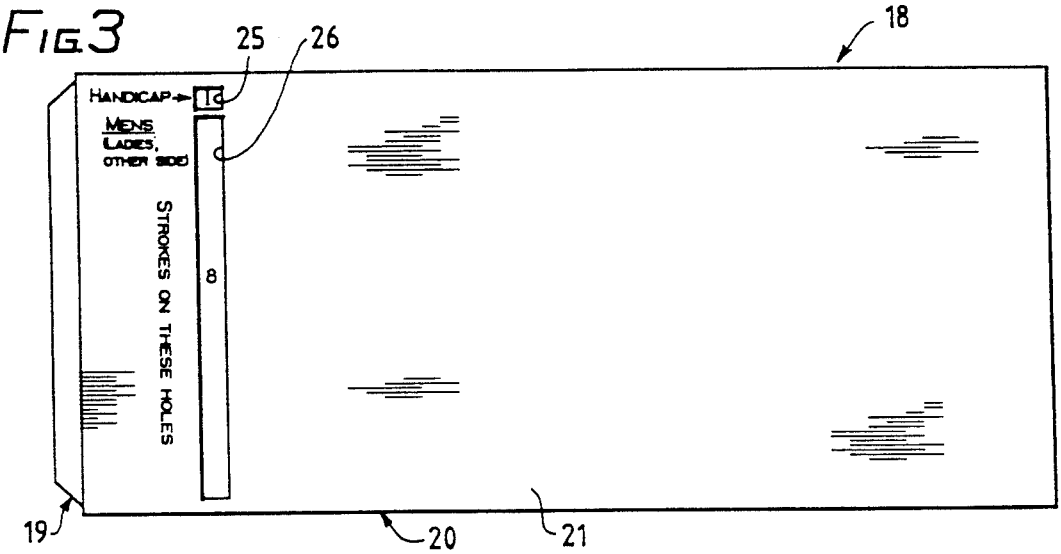
FIG. 3 is a plan view of one side of a device of the invention in which a slide member is slidably held in a holding member for relative rectilinear movement, the illustrated side being designed for indicating means stroke holes of the typical golf course for which the score card of FIGS. 1 and 2 is usable.

Reference numeral 10 generally designates a typical type of score card of the prior art, including a base portion 11 shown in FIG. 1 foldably connected to a somewhat shorter flap portion 12 along a fold line 13. Spaces on the left for entry of names of golfers are at in a region 14 of the base portion 11 at the left of a front nine indicia region 15 which is shown in the unfolded condition of FIG. 1 and which includes yardage and handicap information as well as spaces for entry of hole-by-hole scores and totals for the front or "out" nine. Only a portion of the flap portion 12 is shown in FIG. 1. When the card 10 is folded, as shown in FIG. 2, back nine indicia in a region 16 on the flap portion 12 appears to the right of the name-entry region 14 of the base portion.

As is typical, mens and ladies handicap information is provided on the card 10 and is based upon the estimated difficulty of play, the No. 1 handicap hole being the most difficult and the No. 18 handicap hole being the least difficult. In the illustrated card, the No. 1 mens handicap hole is the No. 8 hole in the order of play, while the No. 1 ladies handicap hole is No. 3 in the order of play. A man golfer who, for example, has a handicap of 7 strokes less than that of another man golfer should give one stroke on each of 7 "stroke" holes, which in the illustrated would be holes Nos. 3, 6, 8, 9, 10, 11 and 14, as may be determined by careful inspection of the card 10.

The devices of the invention facilitate the quick and accurate determination of stroke holes, saving time and obviating errors. FIGS. 3–7 illustrate a relatively simple device of the invention, generally designed by reference numeral 18. The device 18 includes a slide member 19 of sheet material is partially inserted into a holding member 20 for relative rectilinear sliding movement.

Figure 4:
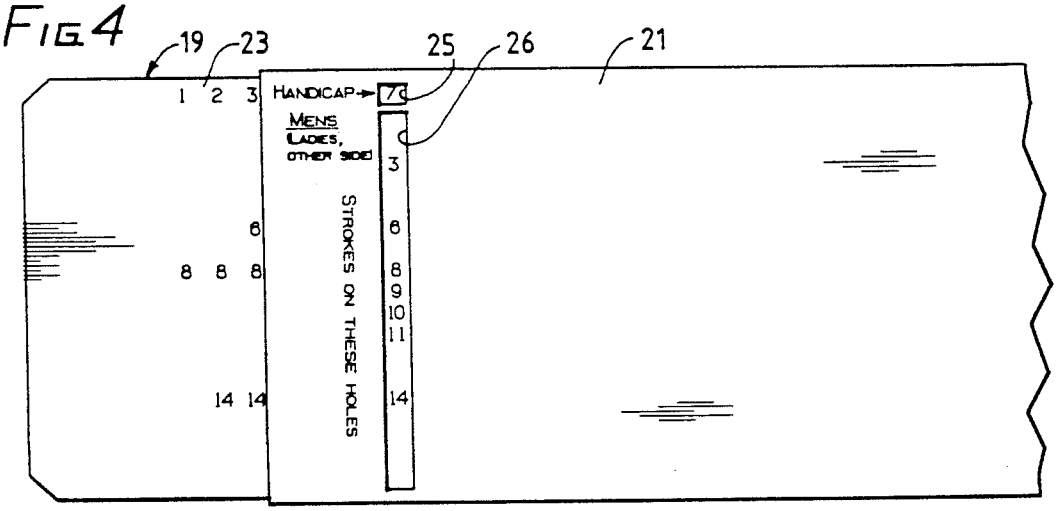
FIG. 4 is a view similar to FIG. 3, but with relative movement to the right of the holding member of the device in relation to the slide member thereof, to illustrate operation of the device.
Figure 5:
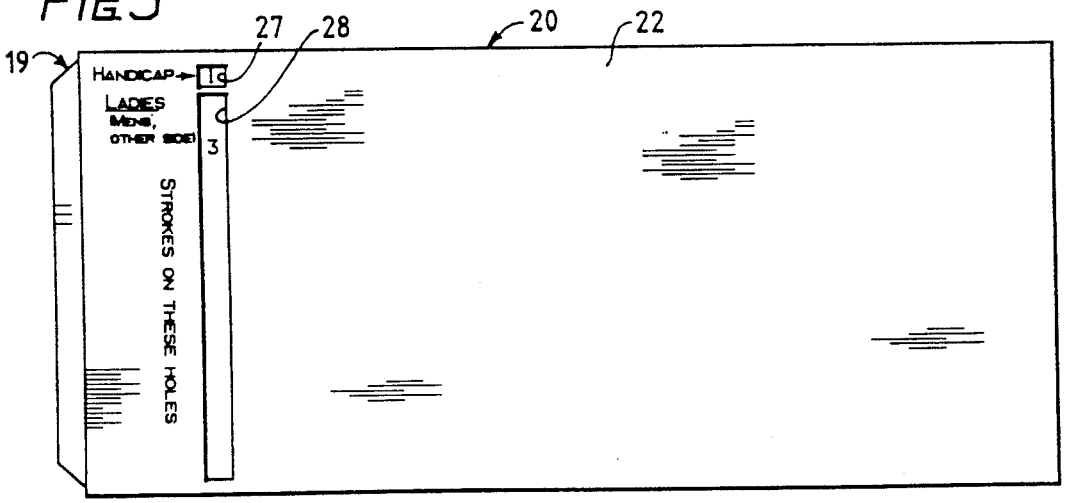
FIG. 5 is a plan view of an opposite side of the device shown in FIG. 3, designed for indicating ladies stroke holes of the same typical golf course.

The illustrated holding member 20 includes two registering rectangular sheets 21 and 22, sheet 21 being shown in FIGS. 3 and 4 and sheet 22 being shown in FIG. 5. Sheets 21 and 22 are connected together along three pairs of adjacent edges, leaving a fourth pair of adjacent edges open for insertion of the slide member 19. For example, the member 20 may be formed of a blank which is folded along a fold line to provide one pair of connected edge and which includes flaps on edges of one of the sheets 21 or 22, adhesively secured to edges of the other sheet to provide the other pair of connected edges. For durability and to reduce sliding friction, the slide member 19 is preferably encapsulated in or coated with a transparent plastic material and a transparent plastic coating may also be applied to the holding member 20.

In the illustrated device 18, a mens handicap face 23 of the slide member 19 and the sheet 21 of the holding member 20 are usable in indicating mens stroke holes, while an opposite ladies handicap face 24 of the slide member 19 and the sheet 22 of the holding member 20 are used in indicating ladies stroke holes. As shown, the sheet 21 has a handicap difference indicating window 25 and a stroke hole indicating window 26 through which indicia on the mens handicap face 23 of the slide member 19 may be observed. A number on face 23 appears through window 25 according to a difference between handicaps of competing men golfers while at the same time, indica appears through window 26 to indicate stroke holes on which strokes should be given by one man to another.

Similarly, the sheet 22 has a handicap difference indicating window 27 and a stroke hole indicating window 28 through which indicia on the opposite ladies handicap face 24 of the slide member 19 may be observed. A number on the ladies handicap face 24 appears through window 27 according to a difference between handicaps of competing ladies golfers while at the same time, indica appears through window 28 to indicate stroke holes on which strokes should be given by one lady to another.

In FIG. 3, the device is shown in an initial position in which the number 1 appears through window 25 while the number 8 appears in window 26 and the number 3 appears through window 28, showing with a handicap difference of 1 between two men, a stroke should be given on the No. 8 hole in the order of play, it being the No. 1 mens handicap hole. When the device is flipped over, as shown in FIG. 5, the number 1 also appears through window 27 while the number 3 appears in window 28, showing that with a handicap difference of 1 between two ladies, a stroke should be given on hole No. 3 in the order of play.

In the initial position of FIGS. 3 and 5, an end portion 29 of the slide member 19 protrudes from the holding member 20 to be held between a finger and thumb of one hand of a user while holding member 20 is held in the opposite end, the hands being moved apart to effect relative movement rectilinear movement of the two member and to provide an indication of stroke holes when there is a handicap difference of more than 1. FIG. 4 shows the members adjusted for a handicap difference of 7, the number 7 appearing in the window 25. In this condition, stroke holes are indicated to be 3, 6, 8, 9, 10, 11 and 14 by the numbers which appear in the window 26.

Figure 6:
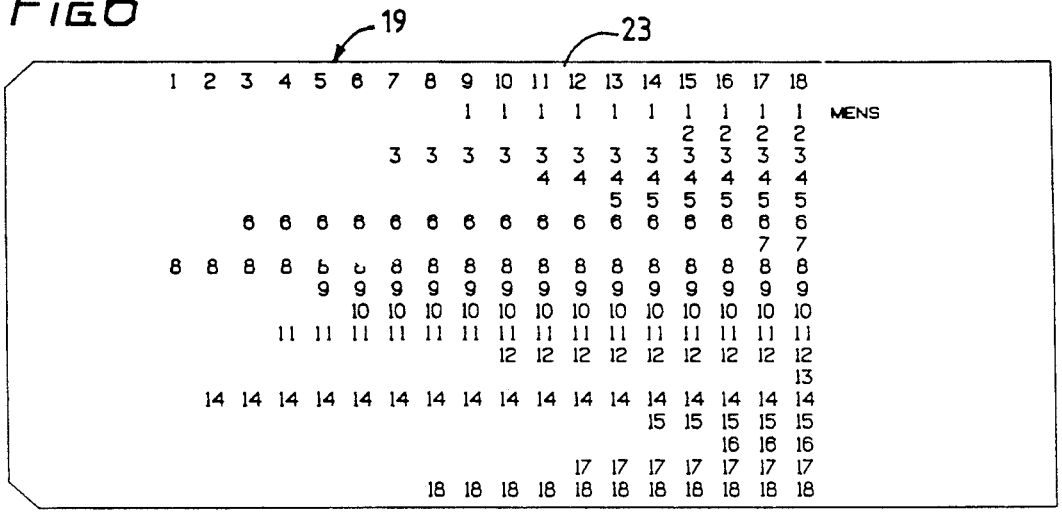
FIG. 6 is a plan view of one side of the slide member of the device of FIGS. 3, 4 and 5.

FIG. 6 shows the complete mens handicap face 23 of the slide member with a row of handicap difference indicating numbers 1 through 18 along the upper edge of the member as illustrated, usable to select a corresponding stroke-hole indication, each stroke hole indication including one or more stroke-hole-indicating numbers in registry with the corresponding handicap difference indicating number. For example, the stroke hole indication for the handicap difference indicating number 1 is the number 8 while the stroke hole indication for the handicap difference indicating number 7 is formed by the numbers 3, 6, 8, 9, 10, 11 and 14 which are in registry with the number 7 of the row of numbers along the upper edge of the face 23.

In each case, the stroke hole indication includes an indication of any hole of the golf course having a handicap order number equal to the handicap difference number. For example, the stroke hole indications for numbers 1, 2, 3, 4 and 5 respectively include the numbers 8, 14, 6, 11 and 9. In addition each stroke hole indication includes any and all holes of the golf course having a handicap order number less than the corresponding handicap difference indicating number. Thus, for example, the stroke hole indication for the handicap difference number 2 includes number 8 as well as number 14 and the stroke hole indication for the handicap difference number 3 includes both numbers 8 and 14 as well as number 6.

As is also shown, the stroke hole indications indicate the stroke hole numbers in numerical order which is advantageous since scoring is typically performed in such order and since the scorer may wish to use the device 18 make check marks or other indications of the stroke holes on the score card in which the hole indicia are in numerical order.

Figure 7:
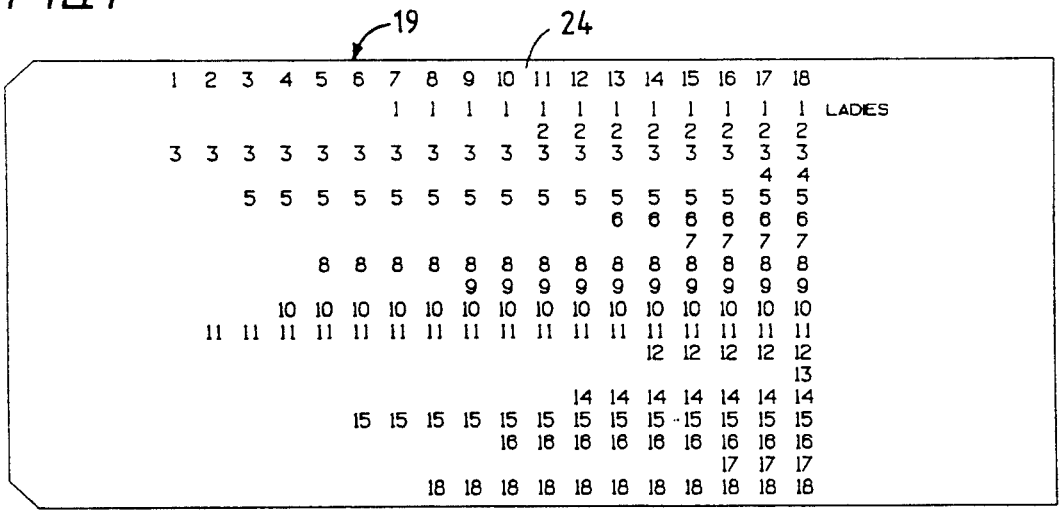
FIG. 7 is a plan view of an opposite side of the slide member shown in FIG. 6.

As shown in FIG. 7, the ladies handicap face 24 of the slide member 19 has a format like that of the mens handicap face 23, and similar comments apply thereto.

Registration of the handicap indicating numbers and the handicap indicating numbers is facilitated through the vertical alignment thereof on the faces of the member 19, and registration can be accomplished visually simply through such vertical alignment. An edge of the holding member 20, or of a score card or other member can be used to further facilitate registration. For example, as shown in FIG. 4, the handicap difference number 3 and the corresponding stroke hole indicating numbers 6, 8 and 14 are aligned along the left-hand edge of the sheet 21 of the holding member 20. However, the use of the windows 25–28 in the illustrated device 18 has important advantages in that each stroke hole indication on the member 19 is in registry with one of the windows 26 or 28 when the corresponding handicap difference number is in registry with the corresponding window 25 or 27. This feature provides a focus of attention to one handicap difference number and the corresponding stroke hole indication and minimizes any possibility of error.

FIGS. 8–11 illustrate another form of device which is constructed in accordance with the principles of the invention and which is generally designed by reference numeral 30. In the device 30, a slide member 31 is provided which is of circular form and of sheet material and which is supported for pivotal movement by a holding member 32 formed by two registering rectangular sheets 33 and 34 of a suitable thin cardboard or other sheet material. The sheets 33 and 34 forming the holding member 32 are respectively usable with a mens handicap face 35 and a ladies handicap face 36 which are on opposite sides of the circular slide member 31, the face 35 being shown in FIG. 9 and the ladies handicap face being shown in FIG. 11.

In the illustrated device, a connecting member 38 is provided which connects central portions of the sheets 33 and 34 of the holding member 32, which provides a pivot for rotation of the circular slide member 31 and which also limits angular movement of the circular slide member 31. The connecting member 38 is preferably in the form of an ordinary staple and includes a first and second portions 39 and 40 shown in FIGS. 9 and 11 which extend from a bight portion 42 shown in FIG. 10 to end portions 43 and 44 shown in FIG. 8. The first pin portion 39 extends from the bight portion 42 and through a small opening in the sheet 34, a small opening in the center of the circular slide member 31 and a small opening in the sheet 33 to the end portion 43 and acts as a pivot pin for journaling the circular slide member 31 for rotation relative to the holding member 32.

Figure 8:
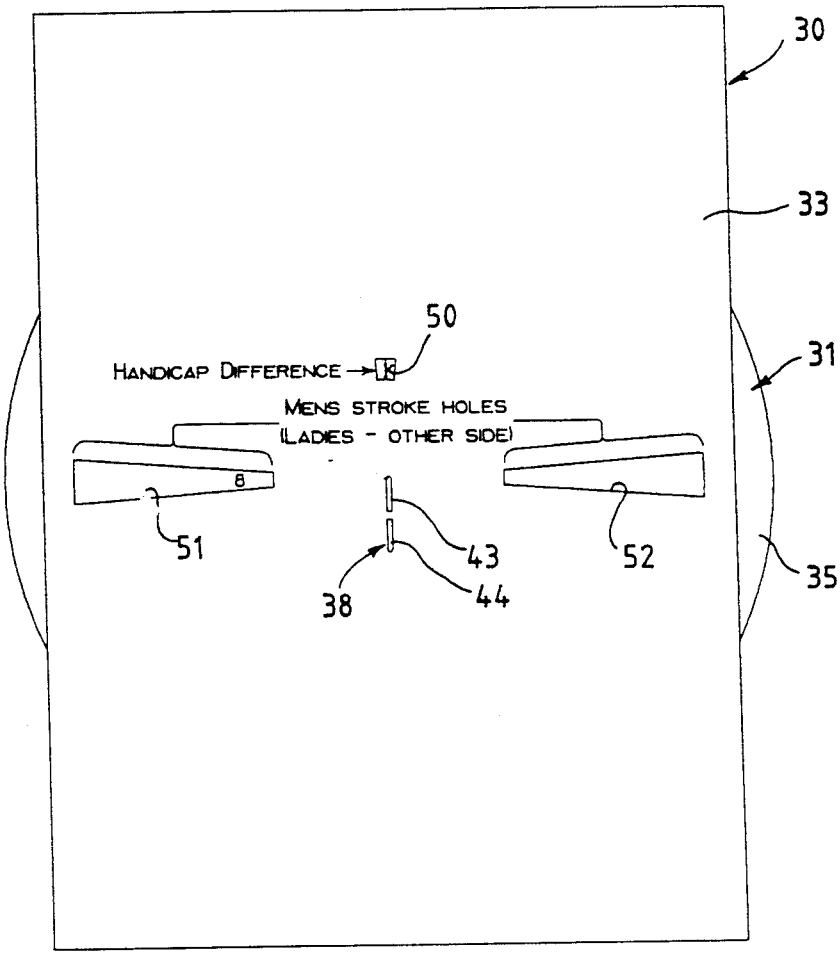
FIG. 8 is a plan view of one side of another device of the invention in which a circular slide member is held between two sheets of a holding member for relative pivotal movement.

The second portion 40 of the staple member extends from the bight portion 42 and through a small opening in the portion 34, then through a large arcuately extending opening 45 in the slide member 31 and then through a small opening in the sheet 33 of holding member 32 to the end portion 44 shown in FIG. 8. The opening 45 in the circular slide member 31 extends for slightly more than 180 degrees to end edges 47 and 48 which engage the portion 40 to limit rotation of the circular slide member to about 180 degrees. Thus one portion 39 of the staple member 38 acts as a pivot pin and the other limits angular movement of the circular slide member 31, the staple member also functioning to hold central portions of the rectangular sheets 33 and 34 together.

The four corner portions of the sheets 33 and 34 are preferably secured together by a suitable adhesive but staples or other connecting means may be used, if desired.

Figure 9:
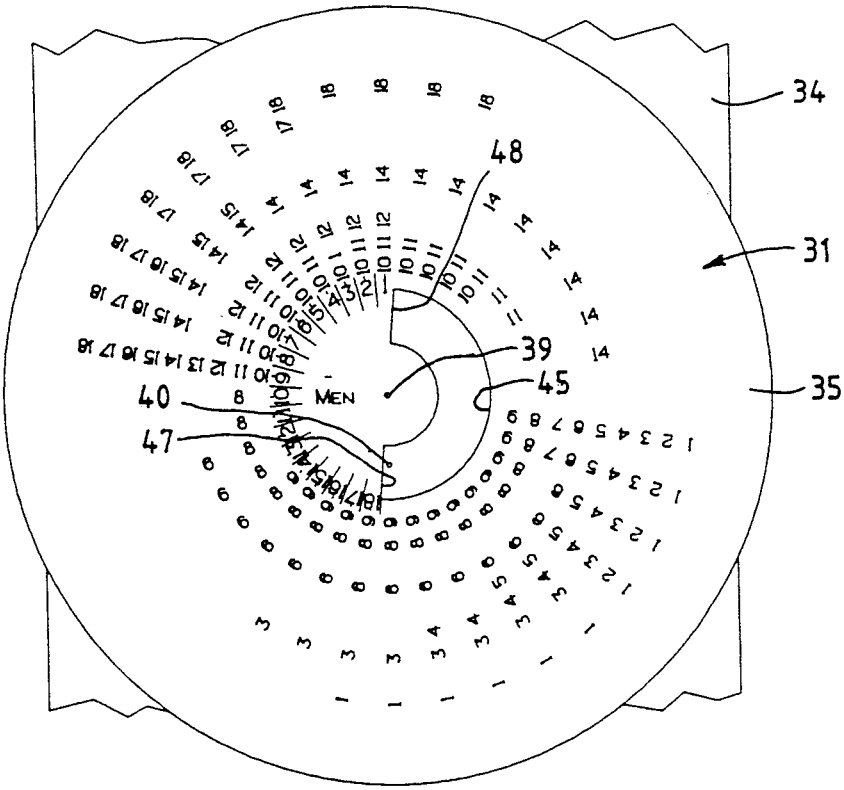
FIG. 9 is a view similar to FIG. 8 but with one of the sheets of the holding member removed to show one face of the circular slide member of the device.

As shown in FIG. 9, the mens handicap face 35 of the circular slide member 31 includes handicap difference numbers 1 through 18 at equi-angular spacings of 10 degrees and at the same radial distance from the central axis of the member 31. Such handicap difference numbers are visible through a window 50 in the sheet 33, the number 1 being visible when the circular slide member 31 is in the position as illustrated. By rotating the member 31 in a clockwise direction through increments of 10 degrees, the numbers 2 through 18 may be sequentially brought into view.

The mens handicap face 35 also includes two series of stroke hole indications, one series being for the front nine and appearing in the lower portion of the illustration of FIG. 9 and the other series being for the back nine and appearing in the upper portion of the illustration of FIG. 9. Indications of the front nine series are visible through a window 51 of the sheet 33 which extends radially outwardly from the central axis of the circular slide member 3 while indications of the back nine series are visible through a similar radially extending window 52 which is diametrically opposed to the window 51.

In the illustrated device 30, the front nine window 51 is offset 90 degrees in a counterclockwise direction from the handicap difference window 50, while the back nine window 52 is offset 90 degrees in a clockwise direction. Similarly, each stroke hole indication of the front nine series of indications on the face 35 is offset 90 degrees in a counterclockwise direction from a corresponding one of the handicap difference numbers thereon and each stroke hole indication of the back nine series is offset 90 in a clockwise direction from a corresponding one of the handicap difference numbers. It is also noted that the numbers of the stroke hole indications of the front nine series are in numerical order going in toward the central axis while those for the back nine series are in numerical order going out from the central axis so that they are in numerical order as they appear in the windows 51 and 52.

Figure 10:
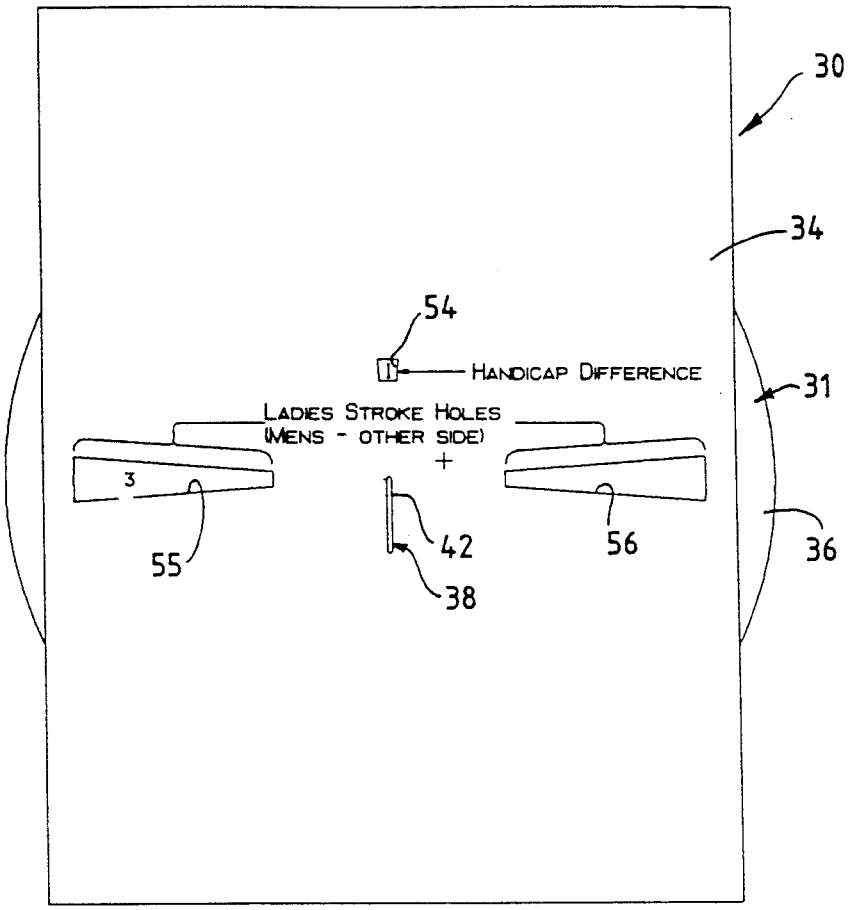
FIG. 10 is a plan view of an opposite side of the device of FIG. 8.
Figure 11:
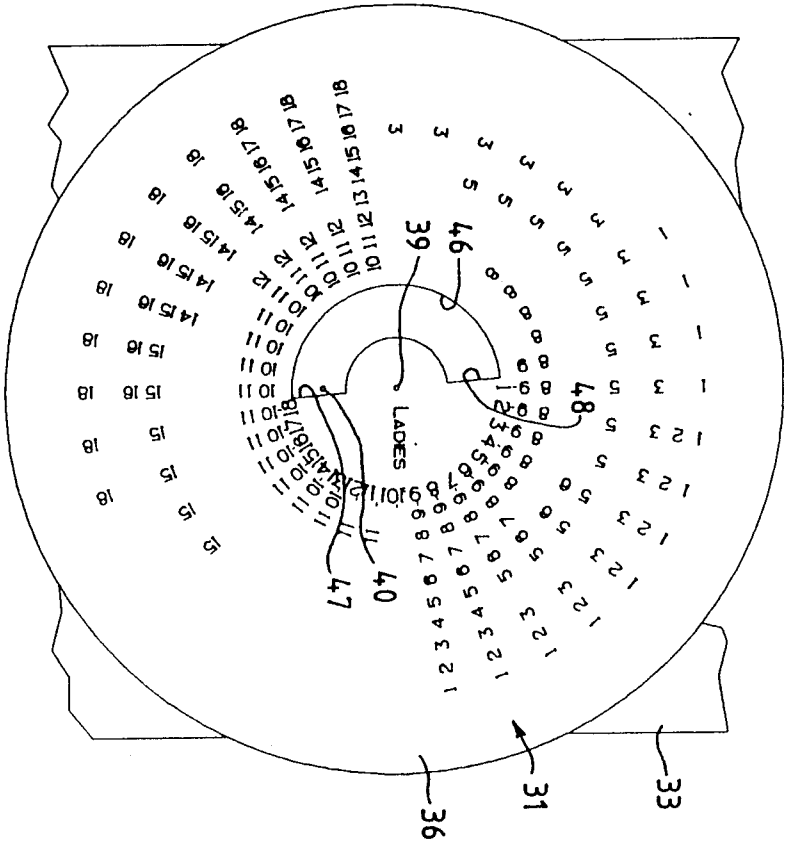
FIG. 11 is a view similar to FIG. 10 but with a second one of the sheets of the holding member removed to show a face of the circular slide member which is opposite that shown in FIG. 9.

In the sheet 34 for use in showing ladies stroke holes, a handicap difference window 54 and front and back nine stroke hole windows 55 and 56 are provided, corresponding in function to the windows 50, 51 and 52 as above described. The ladies handicap face 36 is constructed in a manner similar to the mens handicap face 35 except, of course, for the differences in handicap holes and except also to allow for the fact that the direction of rotation as viewed in FIGS. 10 and 11 is opposite that as viewed in FIGS. 8 and 9. Thus, for example, handicap difference numbers increase from 1 to 18 going in a clockwise direction and a series of stroke hole indications for the front nine appears in the upper portion of the illustration of FIG. 11 while a series of stroke hole indications for the back nine appears in the lower portion of FIG. 11.

Figure 12:
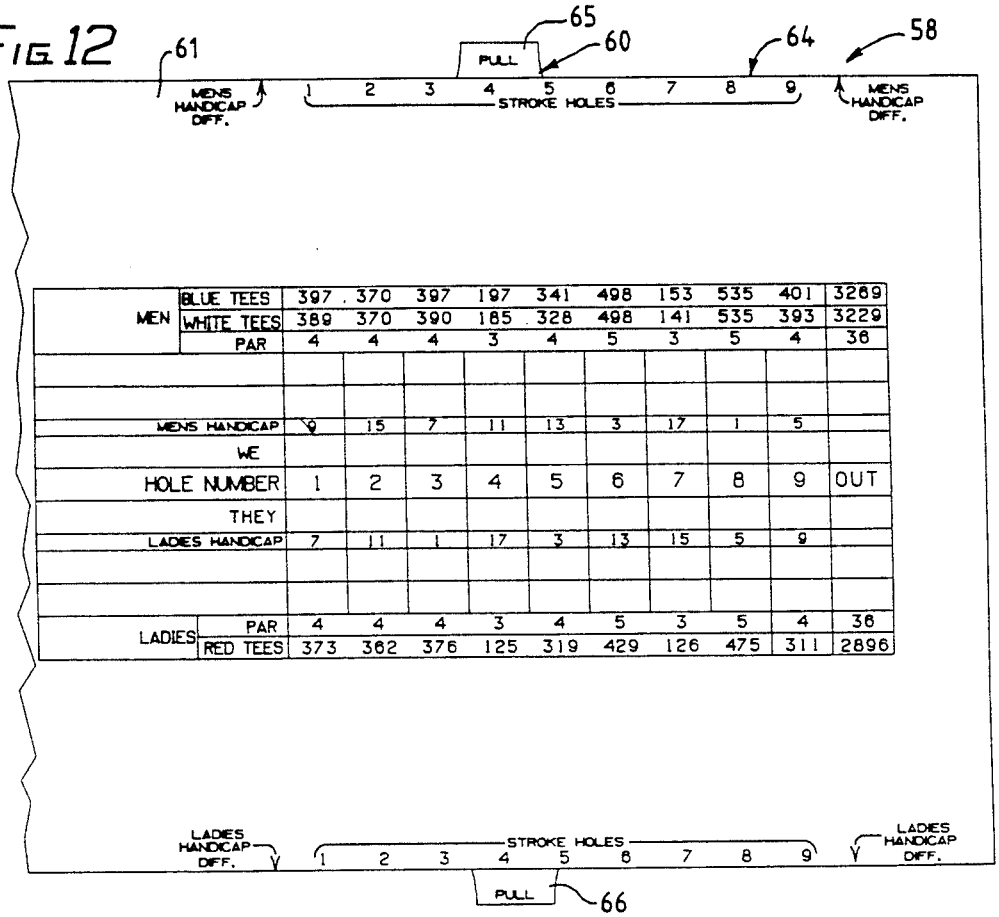
FIG. 12 is a plan view of another form of device of the invention in which a slide member is movably held for rectilinear movement between sheets of a holding member which also provides a score card, front nine indicia being shown.
Figure 15:
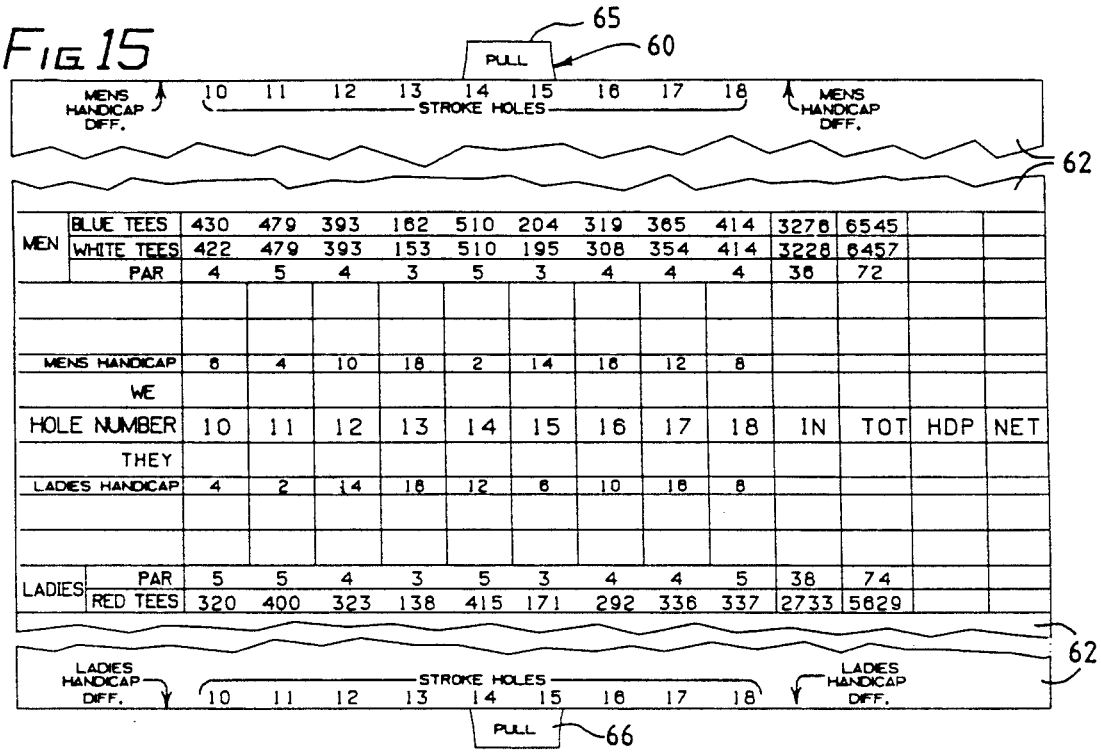
FIG. 15 is a view similar to FIG. 12, but showing an opposite side of the device and back nine score card indicia.

In FIG. 12, reference numeral 58 generally designates another form of device constructed in accordance with the principles of the invention. In the device 58, a slide member 60 is held for rectilinear movement between sheets 61 and 62 of a holding member 64 which also provides a score card. Front nine indicia is provided on the sheet 61 as shown in FIG. 12 while back nine indicia is provided on the sheet 62 as shown in FIG. 15.

Figure 14:
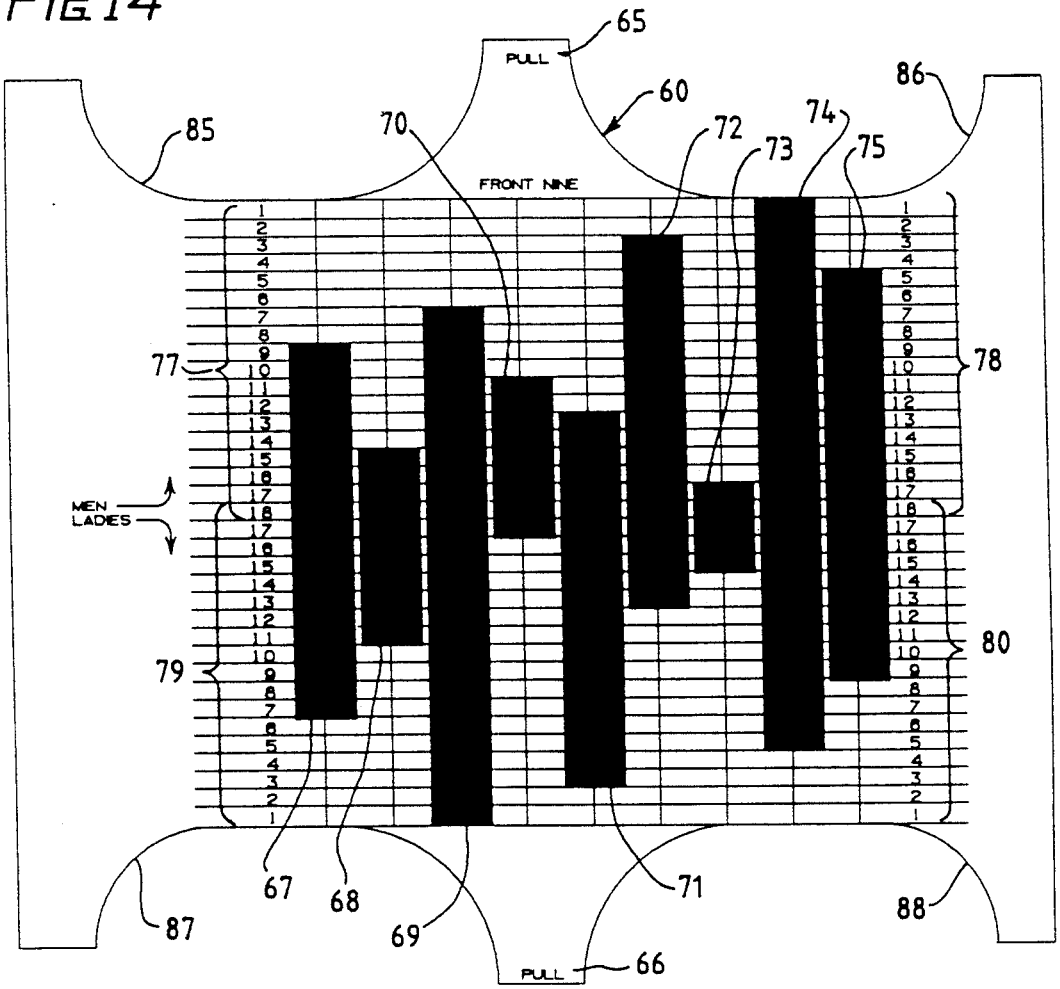
FIG. 14 is a view illustrating one side of the slide member of the device of FIGS. 12 and 13.

The slide member 60 includes two tab portions 65 and 66 for moving the member upwardly or downwardly. As is shown in FIG. 14, a front nine face of the slide member 60 includes nine vertically extending and horizontally spaced indicating bars 67–75, two series of mens handicap difference numbers 1–18 which are indicated by reference numeral 77 and 78 and which are in horizontal alignment along opposite sides of the bars 67–75 and two series of ladies handicap numbers 1–18 which are indicated by reference numerals 79 and 80. As shown, the mens handicap difference numbers increase in value going downwardly and the ladies handicap numbers increase in value going upwardly and the number 18 is shared by the mens and ladies series.

Figure 13:
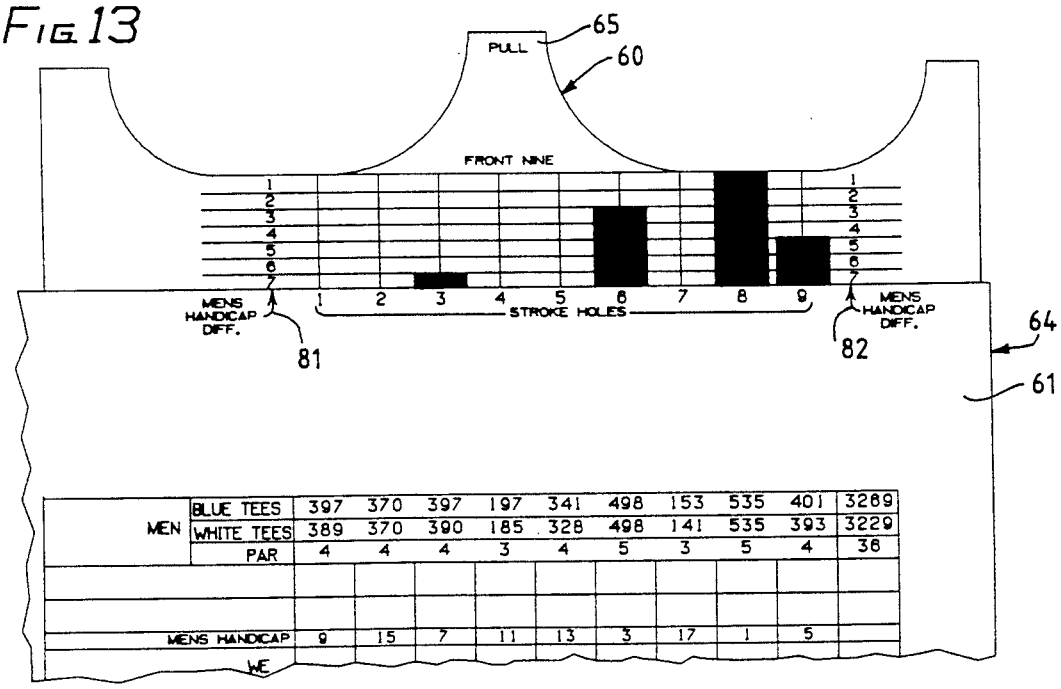
FIG. 13 is a view similar to FIG. 12, but showing the slice member pulled out to a certain position, to illustrate the operation of the device.

FIG. 13 shows the condition of the device after the tab 65 is pulled upwardly to place the slide member 60 in a position such that the mens handicap difference number 7 appears at two locations immediately adjacent two arrows 81 and 82 at the upper edge of the front nine indicia carrying sheet 61 and in which portions of the four indicating bars 69, 72, 74 and 75 appear above the upper edge of the sheet 61 and in alignment with stroke hole indicating numbers 3, 6, 8 and 9 and also in alignment with indicia for holes 3, 6, 8 and 9 on the sheet 61.

The vertical dimensions and positions of the stroke hole indicating bars 67–75 are such that mens stroke holes for the front nine are accurately indicated by any of such bars which project upwardly beyond the upper edge of the sheet 61 when the slide member 60 is moved upwardly to position two identical handicap difference numbers of the series 77 and 78 immediately above the upper edge of the sheet 61. Similarly ladies stroke holes for the front nine are accurately located by any of the stroke hole indicating bars which project downwardly beyond the lower edge of the sheet 61 when the slide member 60 is moved downwardly to position two identical handicap difference numbers of the series 79 and 80 immediately below the lower edge of the sheet 61.

Figure 16:
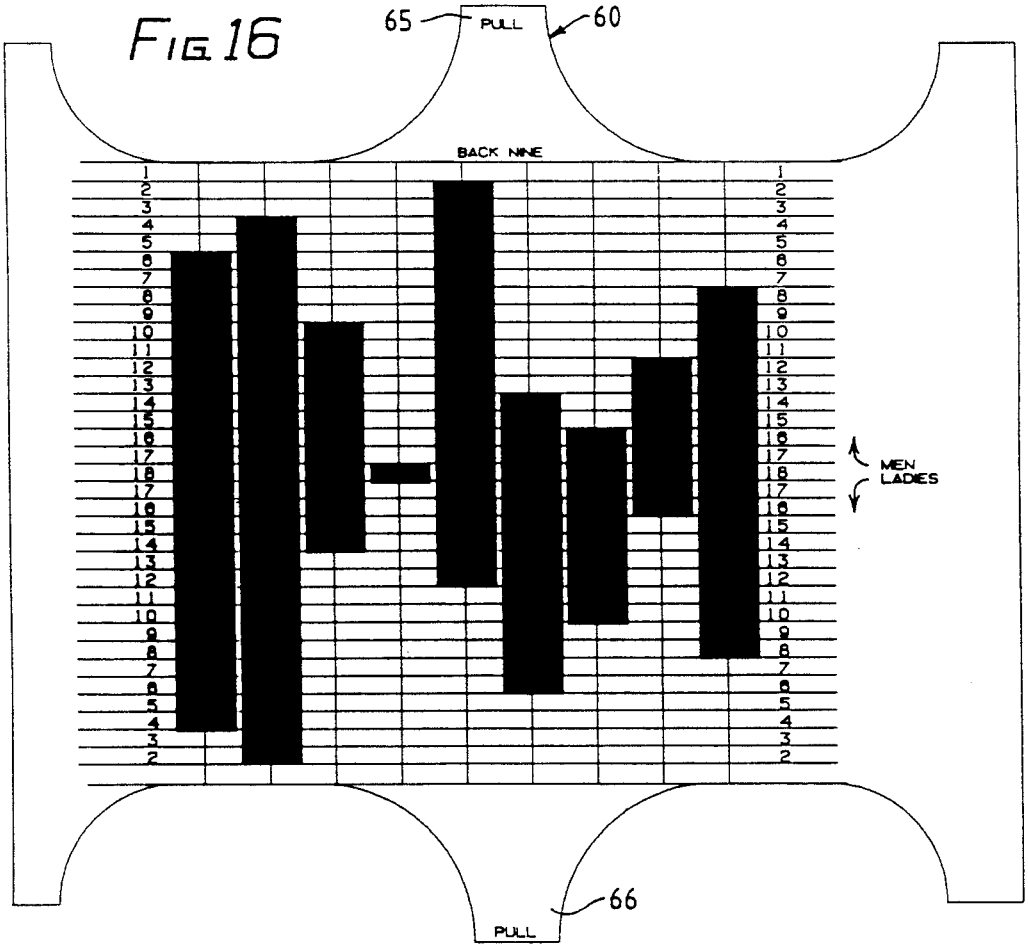
FIG. 16 is a view showing a side of the slide member of the device of FIGS. 12–15 which is opposite that shown in FIG. 14.

FIG. 15 shows the appearance of the device 58 when it is turned over to present the back nine indica of the sheet 62 for view and FIG. 16 shows the back nine face of the slide member 60. The operation is substantially identical to the front nine operation, differing only with respect to the configuration of stroke hole indicating bars in accordance with the difference in handicap holes for the back nine. Preferably, the device is turned over by turning about one of the side edges, rather than about one of the upper or lower edges, so that the pull tabs 65 and 66 remain in the same orientation, as is shown, and so that when the slide member 60 is adjusted for one nine, it can be simply turned over to show the stroke holes for the other nine.

In the illustrated device 58, the upper ends of the mens handicap difference number series 77 and 78 and lower ends of the ladies handicap difference series 79 and 80 are respectively spaced a substantial distance below the upper and lower edges of the holding member 64 when the slide member is in its intermediate position as shown. in FIG. 12. This allows for the provision of recessed portions 85 and 86 in the upper portion of the slide member 60 on opposite sides of the tab 65 and recessed portions 87 and 88 in the lower portion of the slide member 60 on opposite sides of the tab 66. Such recessed portions, in turn, allow the user to exerted squeezing forces on corresponding portions of the sheets 61 and 62 without exerting frictional pressures which might interfere with movement of the slide member 60. This feature is not essential, especially if the sheets 61 and 62 are of a sufficiently rigid material.

Figure 17:
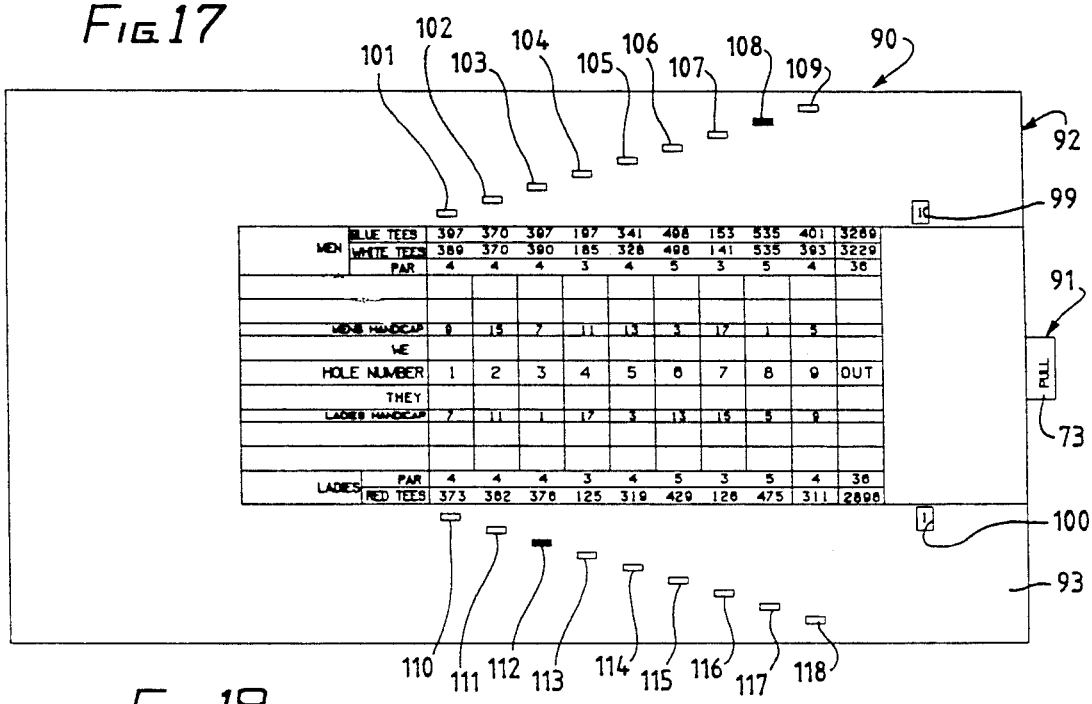
FIG. 17 is a plan view of another form of device of the invention, similar to that of FIGS. 12–16 but in which the direction of rectilinear movement of a slide member relative to score card indicia is transverse to the direction of relative movement in the device of FIGS. 12–16.

In FIG. 17, reference numeral 90 generally designates another form of device constructed in accordance with the principles of the invention. The device 90 is similar to that of FIGS. 12–16 and includes a slide member 91 supported by a holding member 92 which carries score card indicia. The device 90 differs from the device 58 in that the direction of rectilinear movement of the slide member 91 relative to score card indicia on the holding member 92 is parallel to rows of yardage, par, score entry, handicap and hole number indicia on the member 92, rather than transverse to such indicia as is the case in the device 58.

Figure 19:
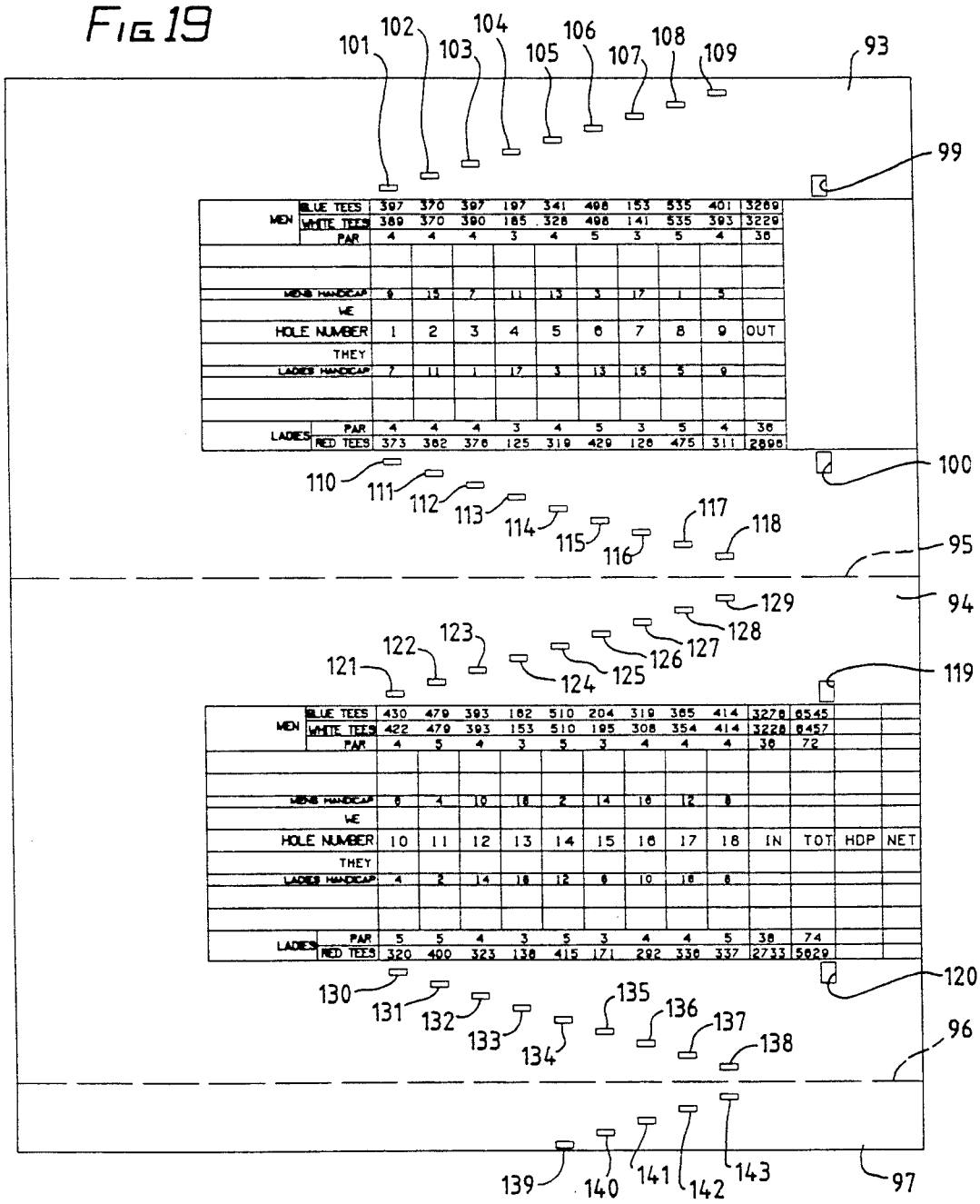
FIG. 19 is a view illustrating a holding member of the device of FIGS. 17 and 18, before being folded.

The holding member 92 includes two rectangular sheets 93 and 94 which may preferably be formed by folding a member of sheet material along score lines 95 and 96 as shown in FIG. 19. A flap 97 which is connected to one edge of the sheet 94 along the fold line 96 is adhesively secured to an edge portion of the sheet 93 which is opposite that connected to the sheet 94 along the fold line 95, to thereby form the holding member 92 for slidably receiving the slide member 91.

The sheet 93 carries front nine indica and is also formed with two handicap difference view windows 99 and 100, a series of nine mens stroke hole view windows 101–109 and a series of nine ladies stroke hole view windows 110–118, such windows of both series being in vertical alignment with the indicia for holes 1 through 9 in the order of play, but being at progressively higher and lower positions for viewing of stroke hole indications on the slide member 91, as hereinafter described. Similarly, the sheet 94 carries back nine indica and is also formed with two handicap difference view windows 119 and 120, a series of nine mens stroke hole view windows 121–129 and a series of nine ladies stroke hole view windows 130–138. The flap 97 is formed with five windows 139–143 which are aligned with the windows 105–109 of the sheet 93 to permit viewing of portions of the face of the slide member 91 when the blank of FIG. 19 is folded to form the holding member 92 and the slide member 91 is inserted therein.

Figure 20:
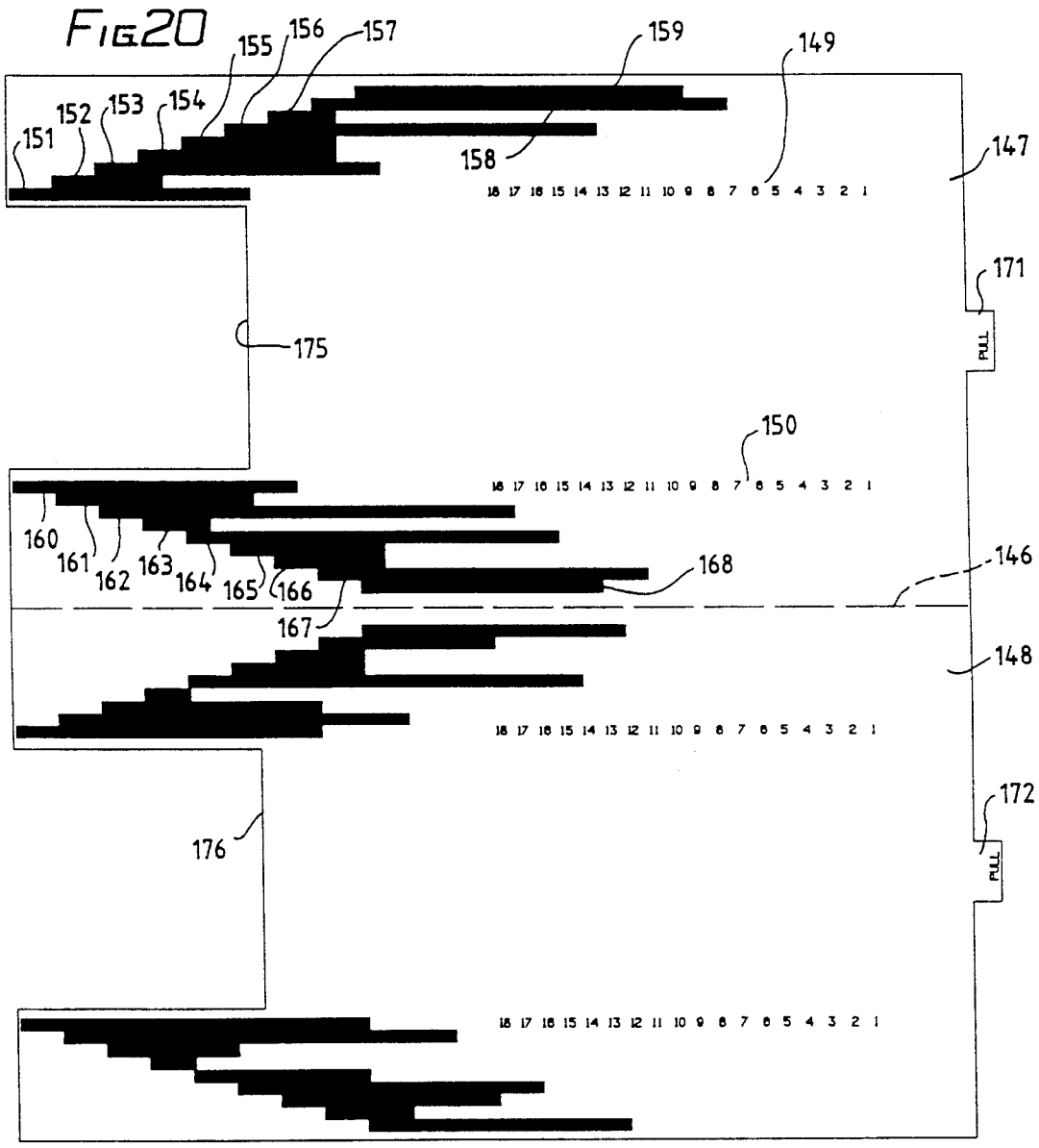
FIG. 20 is a view illustrating a slide member of the device of FIGS. 17 and 18, before being folded.

The slide member 91 may be formed by folding a member of sheet material having a form as shown in FIG. 20 along a central fold line 146 to provide a member 147 defining a face with front nine indications viewable through windows of the sheet 93 and a member 148 defining a face with rear nine indications viewable through windows of the sheet 94. As shown the front nine indications include two series of handicap difference numbers 149 and 150 which are viewable through the windows 99 and 100 of the sheet 93, a series of nine mens stroke hole indicators in the form of bars 151–159 which are viewable through the windows 101–109 and a series of nine ladies stroke hole indicating bars 160–168 which are viewable through the windows 110–118.

The member shown in FIG. 20 is also formed to provide two portions 171 and 172 which are aligned and form a projecting tab 173 when the member is folded along the fold line 146. A suitable adhesive may preferably be used to secure engaged faces of the portions 171 and 172 and of other portions of the member of FIG. 20 together. It is also noted that the member of FIG. 20 is so formed as illustrated as to provide two recessed portions 175 and 176 at the left which are aligned when the member is folded and which are for the purpose of allowing the user to exert squeezing forces on corresponding portions of the sheets 93 and 94 without exerting frictional pressures which might interfere with movement of the slide member 91. This feature is not essential, especially if the sheets 93 and 94 are of a sufficiently rigid material.

Figure 18:
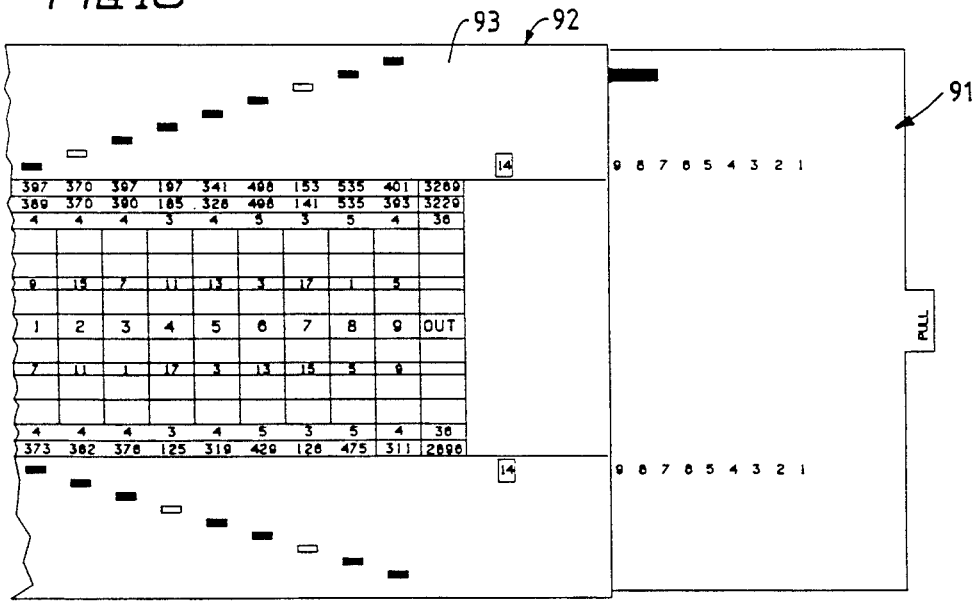
FIG. 18 is a view similar to FIG. 17, but showing the slide member pulled out to a certain position, to illustrate the operation of the device.

The operation of the device is shown in FIGS. 17 and 18. In an initial position of FIG. 17, the number 1 of the two handicap difference series 149 and 150 are visible through the windows 99 and 100, a portion of the mens stroke hole indicating bar 158 is visible through the window 108 and a portion of the ladies stroke hole indicating bar 162 is visible through the window 112. Such visible indicating portions indicate that with a handicap difference of 1, a stroke should be given between men on hole No. 8 in the order of play and that a stroke should be given between ladies on hole No. 3 in the order of play. FIG. 18 shows the condition when the tab 173 is used to pull the slide member 91 to the right until the numbers 14 are visible through the windows. In this condition, stroke hole indications are visible opposite those holes of the front in the order of play at which strokes should be given between men or between ladies, based upon a handicap difference of 14.

The operation with respect to the back nine is the same, differing only in differences the configuration of the stroke hole indicators to reflect differences in the order of difficulty assigned to the respective holes.

Figure 23:
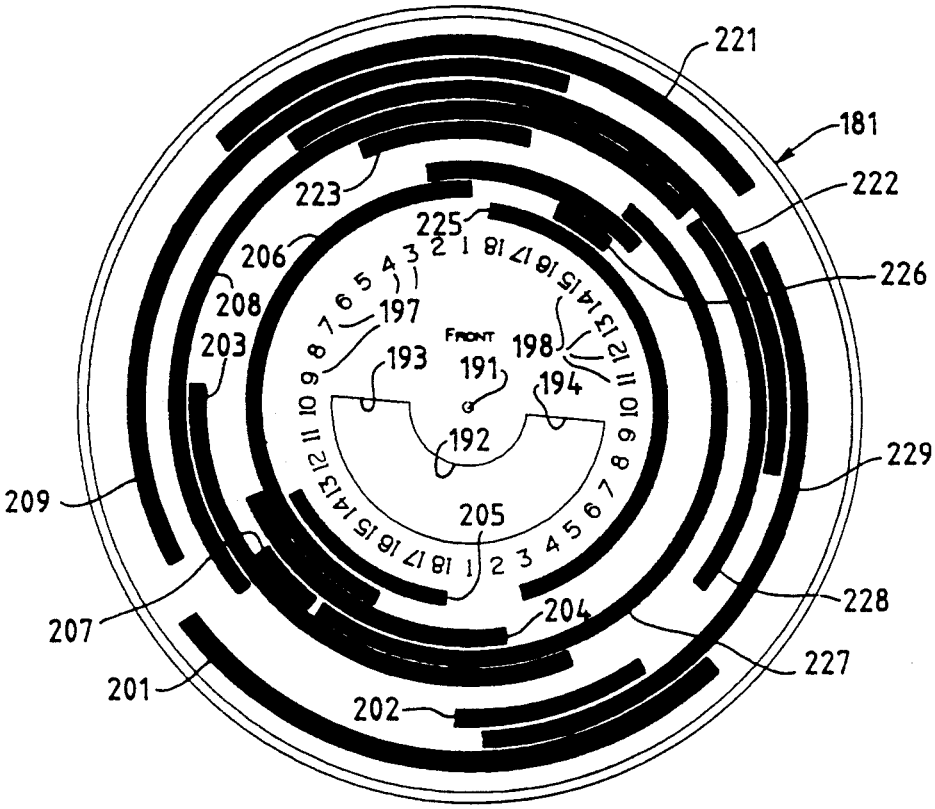
FIGS. 23 and 24 show opposite sides of the pivotal slide member of the device of FIGS. 21 and 22.
Figure 24:
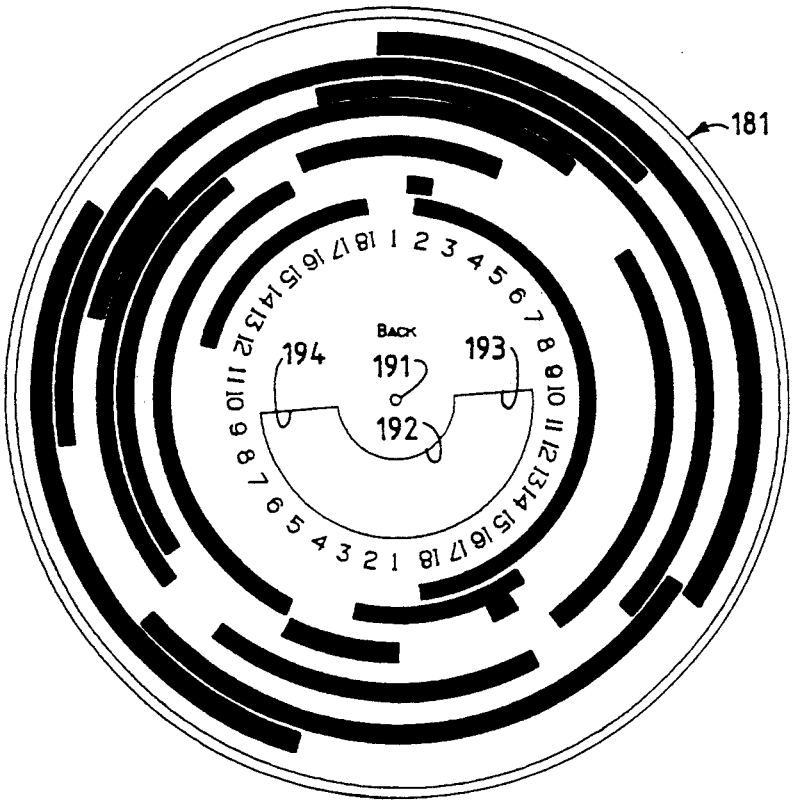

In FIG. 21, reference numeral 180 generally designates another preferred form of device which is constructed in accordance with the principles of the invention. The device 180 is similar to the device 30 of FIGS. 8–11 in that it includes a slide member 181 which is of circular form and of sheet material and which is supported for pivotal movement by a holding member 182 formed by two registering rectangular sheets 183 and 184 of a suitable thin cardboard or other sheet material. A connecting member 186 is provided which is like the connecting member 38 of the device 30 and which operates in the same way, being in the form of an ordinary staple which includes portions extending from a bight portion 188 shown in FIG. 21 to end portions 189 and 190 shown in FIG. 22 and which extend through openings in the sheets 183 and 184 and through openings 191 and 192 in the circular slide member 181. As shown in FIGS. 23 and 24, the opening 191 is of a small size and forms a bearing for pivotal movement of the circular slide member about its central axis. The opening 192 is of larger size and extends arcuately slightly more than 180 degrees to end edges 193 and 194 which are engaged by portions of the connecting member 186 to limit rotation of the circular slide member 181 to about 180 degrees. Thus one portion of the staple member 186 acts as a pivot pin and the other limits angular movement of the circular slide member 181, the staple member also functioning to hold central portions of the rectangular sheets 33 and 34 together.

FIG. 23 illustrates one face of the circular slide member 181 which has front nine indications thereon viewable through windows of the sheet 183 and FIG. 24 illustrates an opposite face of the slide member 181 which has rear nine indications viewable through windows of the sheet 184. Such indications are similar to those of the device 90 of FIGS. 17–20, differing in that indications are arranged to extend arcuately rather than in straight lines.

The front nine indications shown in FIG. 23 include two series of handicap difference numbers 197 and 198 each of which extends arcuately through about 180 degrees, such numbers being viewable through windows 199 and 200 of the sheet 183 shown in FIG. 21. The front nine indications shown in FIG. 23 further include a series of nine mens stroke hole indicators in the form of bars 201–209 which extend arcuately about the central axis of the slide member 181 and at different radial distances from the central axis, such bars 201–209 being viewable through windows 211–219 in the sheet 183 shown in FIG. 21. The windows 211–219 are respectively in vertical alignment with hole number and other indicia of the front nine indicia as shown in FIG. 21 and are at different radial distances from the axis of rotation of the circular slide member which is defined by the right end of the connecting member 186 as viewed in FIG. 21.

The front nine indications shown in FIG. 23 further include a series of nine ladies stroke hole indicators in the form of bars 221–229 which extend arcuately about the central axis of the slide member 181 and at different radial distances from the central axis, such bars 221–229 being viewable through windows 231–239 in the sheet 183 which are shown in FIG. 21 and which are respectively in vertical alignment with hole number and other indicia of the front nine indicia while being at different radial distances from the axis of rotation of the circular slide member 181.

The back nine sheet as shown in FIG. 22 includes mens back nine stroke hole windows 241–249 similar to the mens front nine stroke hole windows 211–219, ladies back nine stroke hole windows 251–259 similar to the ladies front nine stroke hole windows 231–239 and two handicap difference windows 261 and 262.

The back nine indications of the circular slide member 181 are shown in FIG. 24 but are not described in detail since they are similar to the front nine indications, differing in view of the differences in handicap hole assignments and also differing in that the rotation away from an initial position as viewed in FIG. 23 is in a clockwise direction when the rotation as viewed in FIG. 24 is in an opposite counter-clockwise direction.

In FIG. 21, the circular slide member is in an initial position in which the handicap difference number 1 appears in the windows 199 and 200 and in which a portion of the mens stroke hole indicating bar 208 appears in the mens stroke hole indicating window 218 in alignment with the No. 8 hole indicia, while a portion of the ladies stroke hole indicating bar 223 appears in window 233 in alignment with the No. 3 hole indicia.

FIG. 22 shows the device turned over to show the back nine indicia on the sheet 184 and also shows the condition of the device when the circular slide member 181 has been rotated 90 degrees away from the initial position, in a counter-clockwise direction as viewed in FIG. 22. In this condition, the handicap difference number 10 is viewable through windows 261 and 262 in the sheet 184 while mens stroke hole indicating bars are visible through windows 241, 242, 243, 245 and 249 opposite hole numbers 10, 11, 12, 15 and 18 and while ladies stroke hole indicating bars are visible through windows 251, 252, 256, 257 and 259 opposite hole numbers 10, 11, 15, 16 and 18.

It will be understood that modifications and variations may be effected without departing from the spirit and scope of the novel concepts of this invention

What is claimed is:

1. An indicating device or use on a golf course having holes to which handicap order numbers have been assigned in a particular order based upon relative difficulty of play, said device being usable in identifying stroke holes on which strokes may e given by one golfer to another golfer when said golfers have differences in handicaps which are based upon prior performances, said device comprising a plurality of first indicating means for indicating differences in handicaps, and a plurality of corresponding second indicating means for providing indications of stroke holes, support means for supporting said plurality of first indicating means and said plurality of corresponding second indicating means, selection means for selecting first and second indicating means including first and second registry means for permitting viewing of selected ones of said first and second indicating means and interengageable guide means on said support means and said selection means for guiding said support means for adjustable movement relative to said selection means in a certain path to position any selected one of said first indicating means in registry with said first registry means in accordance with a difference in handicaps between said one golfer and said another golfer while positioning at least one of said plurality of corresponding second indicating means in registry with said second registry means to provide an indication by said at least one of said plurality of corresponding second indicating means of stroke holes of said golf course on which strokes are to be given by said one golfer to said another golfer in accordance with said particular order to handicap order numbers.

2. A device according to claim 1, wherein each of said plurality of first indicating means provides an indication of one of a series of consecutive handicap difference numbers, and wherein each of said second indicating means provides an indication of any hole of said golf course having a handicap order number equal to said handicap difference number provided by said corresponding one of said first indicating means and also provides an indication of any and all holes of said golf course having a handicap order number less than said one of said series of handicap difference numbers provided by said corresponding one of said first indicating means.

3. An indicating device as defined in claim 1, comprising a member of sheet material which provides said support means for said plurality of first indicating means and for said plurality of second indicating means, said first and second indicating means including indicia at predetermined relative locations on said member of sheet material.

4. An indicating device as defined in claim 1, said selection means comprising first and second members of sheet material in facing relation with said first and second registry means being carried by at least one of said first and second members of sheet material, and said support means comprising a third member of sheet material held between said first and second members of sheet material while being guided by said interengageable guide means for movement relative to said first and second members of sheet material in said certain path, said first and second indicating means including a plurality of handicap difference indicia and a plurality of stroke hole identifying indicia on said third member of sheet material, one of said plurality of handicap difference indicia being positionable into registry with said first registry means through movement of said third member of sheet material relative to said first and second members of sheet material while positioning said stroke hole identifying indicia of the corresponding second indicating means into registry with said second registry means.

5. A device according to claim 4, said interengageable guide means including means for guiding said third member of sheet material for generally rectilinear movement in said path relative to said first and second members of sheet material.

6. A device according to claim 4, said interengageable guide means including means for guiding said third member of sheet material for pivotal movement in said path about a pivot axis relative to said first an second members of sheet material.

7. A device according to claim 4, wherein one of said first and second members of sheet material includes score card indicia thereon.

8. A device according to claim 7, wherein said score card indicia provides rows of score-entry spaces for entry of hole-by-hole scores of golfers, said stroke hole-identifying indicia being in predetermined registering relation to said score-entry rows of spaces.

9. A device according to claim 7, wherein said score card indicia on said one of said first and second members of sheet material provides rows of score-entry spaces for entry of hole-by-hole scores of golfers, said stroke hole identifying indicia on said third member of sheet material being in predetermined registering relation to said score-entry rows of spaces.

10. A device according to claim 7, wherein said score card indicia includes front nine indicia on said first member of sheet material and back nine indicia on said second member of sheet material, and wherein said plurality of stroke hole identifying indicia on said third member of sheet material includes a front nine group of stroke hole indications on one side of said third member of sheet material for providing indications of front nine stroke holes and a back nine group of stroke hole indications on an opposite side of said third member of sheet material for providing indications of back nine stroke holes.

11. A device according to claim 10, wherein said second registry means includes means for registration with said front nine and back nine groups of stroke hole indications.

12. A device according to claim 11, wherein said second registry means include windows in said first and second members of sheet material.

13. A device according to claim 6, wherein said third member of sheet material includes a first opening about said pivot axis and a second opening spaced radially outwardly from said pivot axis and from said first opening and extending arcuately about said pivot axis, said guide means including a connecting member having first and second portions extending through said first an second members of sheet material and through said first and second openings in said third member of sheet material, said first portion of said connecting member acting to journal said third member of sheet material for rotation about said pivotal axis and said second portion acting to hold portions of said first an second members of sheet material together and to limit rotational movement of said slide member.

14. An indicating device including a slide member of sheet material adapted for use with a holding member on a golf course having holes to which handicap order numbers have been assigned in a particular order based upon relative difficulty of play, wherein said holding member forms a score card and includes first and second generally rectangular sheets which receive said slide member therebetween and wherein said holding member guides said slide member for adjustable movement relative thereto in a vertical direction as viewed, and wherein at least one of sheets of said holding member includes horizontal rows of score-entry spaces for entry of hole-by-hole scores of golfer and consecutive hole-number indicators extending in horizontally spaced relation and in vertically registering relation to said score-entry spaces, said slide member being usable with said holding member in identifying those stroke holes in which strokes may be given by one golfer to another golfer when said golfers have differences in handicaps which are based upon prior performances, said slide member comprising a series of consecutive handicap difference indicating numbers extending in vertically spaced relation along a generally vertically extending line, and a plurality of stroke-hole indicators which correspond to and are in horizontal alignment with said handicap difference indicating numbers, each of said stroke-hole indicators including a stroke-hole indicating portion which indicates each hole having a handicap order number equal to the corresponding handicap difference indicating number and also including a stroke-hole indicating portion which indicates each hole having a handicap order number less than said corresponding handicap difference indicating number, wherein said handicap difference indicating numbers and said corresponding stroke-hole indicators are so located on said slide member and in relation to handicap difference and stroke-hole indexes on at least one horizontal edge of said holding member as to be brought into view along said at least one horizontal edge of one of said rectangular sheets of said holding member during vertical movement of said slide member relative to said holding member.

15. An indicating device as defined in claim 14, wherein each of said stroke hole indicating portions is in vertical alignment with corresponding stroke indexes for the hole number on said indicating holding member.

* * * * *